US007821462B1

(12) United States Patent
Reigle et al.

(10) Patent No.: US 7,821,462 B1
(45) Date of Patent: Oct. 26, 2010

(54) COMPACT, DUAL-POLAR BROADBAND MONOPOLE

(75) Inventors: Kenneth M Reigle, Morristown, NJ (US); Wolodymyr Mohuchy, Nutley, NJ (US); Michael Edward Pekar, Mason, OH (US); John E Riddel, Centerville, OH (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 176 days.

(21) Appl. No.: 12/180,659

(22) Filed: Jul. 28, 2008

(51) Int. Cl.
*H01Q 1/38* (2006.01)
*H01Q 9/28* (2006.01)

(52) U.S. Cl. ..... 343/700 MS; 343/795

(58) Field of Classification Search ..... 343/700 MS, 343/846, 795, 893
See application file for complete search history.

(56) References Cited

U.S. PATENT DOCUMENTS 5,790,080 A 8/1998 Apostolos
6,342,866 B1 * 1/2002 Ho et al. ..... 343/795
6,429,819 B1 * 8/2002 Bishop et al. ..... 343/725
6,847,328 B1 * 1/2005 Libonati et al. ..... 343/700 MS
6,853,351 B1 2/2005 Mohuchy
7,372,409 B2 * 5/2008 Morton ..... 343/700 MS
7,372,424 B2 * 5/2008 Mohuchy et al. ..... 343/795

OTHER PUBLICATIONS

J. D. Kraus, "Antennas", second edition, published by McGraw-Hill Book Co, 1988, chapter 2.

* cited by examiner

*Primary Examiner*—Shih-Chao Chen
(74) *Attorney, Agent, or Firm*—RatnerPrestia

(57) ABSTRACT

A dual-polarized radiating element is formed from two orthogonally oriented monopole radiators disposed on a dielectric substrate. An RF image plane placed orthogonally to the two monopole radiators presents a balanced excitation for element impedance optimization that allows for operation over multiple octave bandwidths with a physically compact device. The dual-polarized radiating element provides a broad field-of-view (FOV) as a stand alone radiator and may be used in a phased array.

19 Claims, 5 Drawing Sheets

COMPACT, DUAL-POLAR BROADBAND MONOPOLE

FIELD OF INVENTION

The present invention relates, in general, to an antenna and, more specifically, to a compact radiating element that may be deployed as a single radiator or configured for use in a phased array. The radiating element operates over multioctave bandwidths, subtends a wide field-of-view (FOV), and responds to any desired polarization in space. The present invention may operate at high peak and average power in the transmit mode and is amenable to conformal installation.

BACKGROUND OF THE INVENTION

It is well known that the efficiency of an antenna diminishes significantly as its dimensions decrease to much less than a wavelength. In such instances complex tuning networks are employed to match the antenna radiation resistance to the transmitter or receiver, where the major portion of the signal is dissipated in the matching network. For example, airborne towel-bar blades operating at VHF/UHF frequencies may exhibit gains as low as −30 dBiL in the lower segments of the operating band. Apostolos in U.S. Pat. No. 5,790,080, entitled "Meander Line Loaded Antenna", discloses that an antenna design may be conceived on a volumetric basis rather than a planar basis, where the limitation on performance is governed by the well known Chu-Harrington relationship that allows an antenna aperture to be much less than a wavelength in its operating frequency band.

In vehicular or airborne applications where space is at a premium and there is a need for efficient antennas operating in the VHF/UHF bands, volumetric solutions to antenna problems are imperative. Additionally, modern systems employ polarization as a significant parameter during system processing and transmission. Consequently, not only must the antenna be compact, but it must also provide independent orthogonal linearly-polarized components to avail the system processors of polarization diversity.

A figure of merit for providing an efficient radiating element is the net gain expressed by the familiar relationship:

$$G=\eta D$$

where: G is the net gain of the antenna
$\eta$ is the antenna efficiency, and
D is the antenna directivity The directivity of a radiator may be defined by the radiated beamwidth of the antenna:

$$D=4\pi/\theta\phi$$

where: $\theta$ and $\phi$ are half-power beamwidths expressed in radians.

With the directivity established by the beamwidths of the radiated element patterns, which cover a broad field-of-view and are reasonably stable with frequency, the improvement in antenna gain may only be achieved by maximizing the antenna efficiency $\eta$. In practice, this translates into optimizing the antenna input VSWR, the voltage standing wave ratio, over the operating bandwidth and employing elements with minimum insertion loss.

This present invention addresses the needs enumerated above, as well as other needs, such as radiating high pulsed and CW power during transmission.

The present invention is related to U.S. Pat. No. 6,853,351, entitled "Compact High-Power Reflective-Cavity Backed Spiral Antenna" by Mohuchy, and U.S. Pat. No. 7,372,424, entitled "High Power, Polarization-Diverse Cloverleaf Phased Array", also by Mohuchy, issued on May 13, 2008, the contents of which are hereby incorporated by reference in their entireties.

SUMMARY OF THE INVENTION

A radio frequency (RF) transmitting and receiving device constructed in accordance with the present invention provides a compact, broadband radiating element with two independent orthogonally-polarized field components. The radiating element includes two radiating microstrip surfaces disposed conformally on a planar substrate in a butterfly-wing arrangement. Each radiating microstrip surface includes an RF launch point and an orthogonal metallic strip for optimizing the input VSWR. Each radiating surface extends beyond and folds over an edge of the radiating element in a predetermined manner which is configured to extend performance at the low end of the operating frequency band. The radiating microstrips of the present invention are disposed at a distance that is less than one-quarter wavelength above a metallic ground plane.

The present invention includes an imaging surface in proximity to the RF launch point of each radiating element. The imaging surface is oriented orthogonally to the metallic ground plane. In this manner, each monopole behaves electrically as a dipole in terms of gain, radiation pattern and input VSWR, and uses only half of the surface area.

It is understood that the foregoing general description and the following detailed description are exemplary, but are not restrictive of the invention.

BRIEF DESCRIPTION OF THE DRAWING

The invention may be best understood from the following detailed description, when read in conjunction with the accompanying drawings. Included within are the following figures.

DETAILED DESCRIPTION OF THE INVENTION

Figure 1:
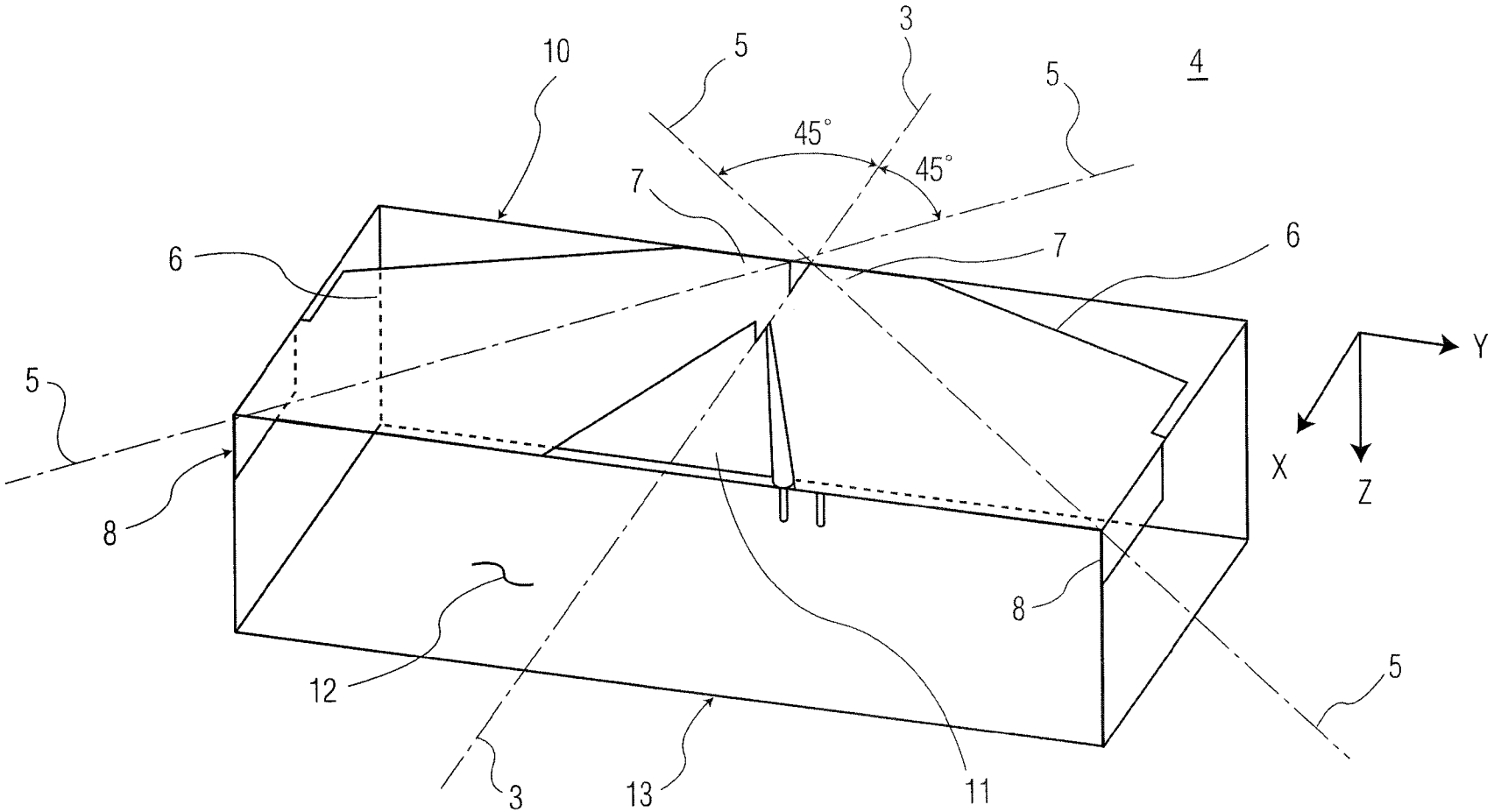
FIG. 1 is a perspective view of the inventive monopole radiating antenna element configured in a triangular butterfly pattern that is conformally mounted as microstrips on a multilayer substrate to form a planar radiating surface, according to an embodiment of the present invention.

Referring to FIG. 1, there is shown a perspective view of the monopole radiating antenna element, in accordance with an embodiment of the present invention. As shown, the monopole radiating antenna element, designated as 4, includes two radiating surfaces 6 (also referred to herein as radiating elements 6), which are arranged as an orthogonal pair in a butterfly pattern. The orthogonal pair of radiating elements is formed conformally on a thin substrate 11 and is oriented at 45° with respect to a principal antenna element axis, designated as 3. The two radiating surfaces, which are arranged in an X,Y plane, extend beyond their surface dimensions, as they are folded into an X,Z plane (shown as two fold-over extensions 8).

The substrate 11 is mounted on a layer of dielectric material, designated as 12. The dielectric layer 12 is supported by a reflective metallic ground plane, designated as 13 (disposed in an X,Y plane). An RF imaging plane (also disposed in an X,Y plane) is formed by metallic surface 10 (the latter disposed in a Y,Z plane). As will be explained below, the RF imaging plane is oriented perpendicular to RF launchers 7. The metallic surface 10 is separated from the two radiating surfaces 6 by an electrically determined separation distance X (shown best in FIG. 2A). In addition, it will be appreciated that the RF imaging surfaces (shown as 6*a* in FIG. 3) are separated from the two radiating surfaces 6 by an electrically determined separation distance 2X.

Figure 2A:
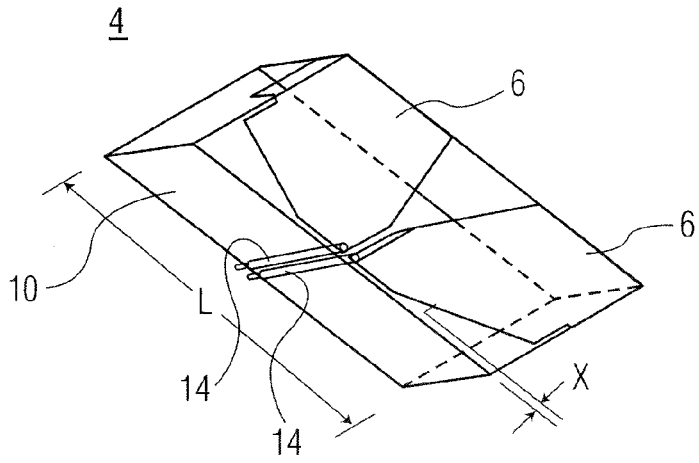
FIGS. 2A, 2B and 2C are different views of the monopole radiating antenna element shown in FIG. 1, according to an embodiment of the present invention.
Figure 2B:
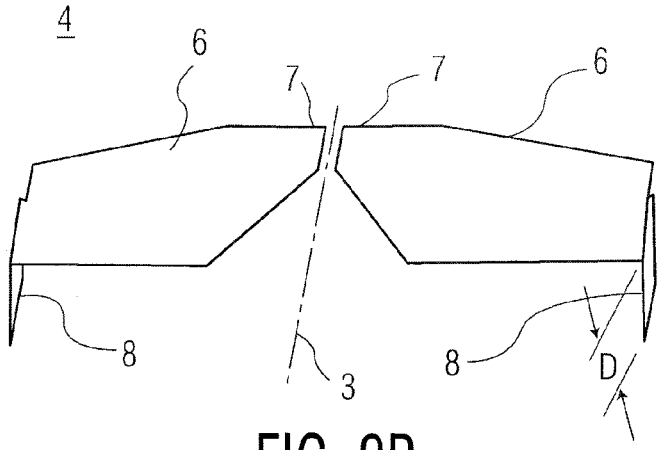
Figure 2C:
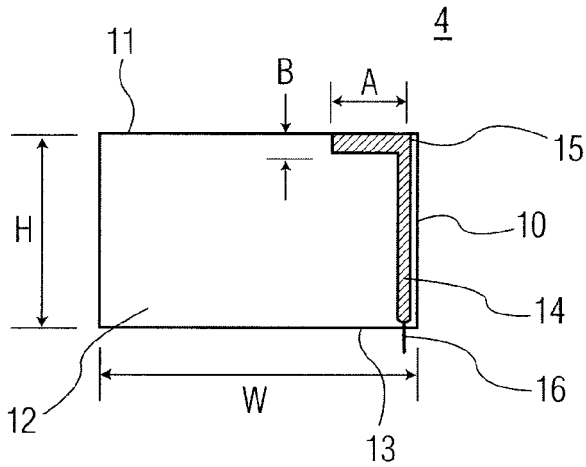

The monopole radiating antenna element is shown in more detail in FIGS. 2A, 2B and 2C. FIG. 2A is a perspective view of the monopole radiating antenna element 4, showing the perpendicular orientation between the two radiating elements 6 and metallic surface 10. Also shown are RF conductors 14 that extend in a generally parallel direction to metallic surface 10 and meet RF launchers 7 (FIG. 2B) of radiating surfaces 6 in a generally perpendicular direction.

FIG. 2B shows the two radiating surfaces (or elements) 6 of the monopole radiating antenna element 4. Also shown are the two fold-over extensions 8 that are oriented perpendicularly to elements 6. Each fold-over extends, as shown, by a distance of D. Also shown are the two RF launchers 7 positioned adjacent the distal ends of radiating surfaces 6 and near metallic surface 10. The RF launchers 7 also intersect orthogonal lines 5 (shown in FIG. 1).

When the inventive radiating elements 6 are deployed in a phased array configuration, the fold-over extension 8 may be eliminated. The inter-element mutual coupling may then be employed to provide desired broadbanding effects.

The RF signal is inputted, or received by a transmission medium, such as RF conductors 14, shown in a perspective view in FIG. 2A. Each RF conductor 14 connects RF terminal 16, shown in FIG. 5, with a respective launcher 7. The RF conductors 14 may also be employed as an impedance transformer between a 50 ohm coaxial input at RF terminals 16 and the radiating elements 6. The choice of a 50 ohm input may be based on the impedance of the transmission line and may be varied to accommodate any input transmission line. In such case, the impedance of transformer 14 (or RF conductors 14) may be selected appropriately. At the output of each RF conductor 14, there may be included a capacitive metallic strip, designated as 15, in order to provide additional impedance tuning and extend the useful bandwidth of the inventive radiating antenna element 4. As shown in FIG. 2C, RF conductor 14 is electrically connected to capacitive metallic strip 15.

It will be appreciated that radiating elements 6 in FIG. 2B may be formed to occupy the maximum available surface area of the top surface of substrate 11, except for the tapers near each RF launcher 7. The tapers may be determined empirically for a minimum input VSWR, using methods well established in the art. Additionally, fold-over extensions 8 may also be determined empirically, while focusing on extending performance at the low frequencies.

A performance tradeoff may be done to determine the distance D of fold-over extensions 8 and their interaction with ground plane 13 (as best shown in FIG. 1, ground plane 13 is disposed substantially parallel to substrate 11 with dielectric layer 12 sandwiched in-between).

Similarly, the dimensions of capacitive metallic strip 15 may be determined empirically for the best input VSWR. The dimensions of capacitive metallic strip 15 are shown in FIG. 2C, as having length A and height B.

Other methods known in the art may be employed to perform RF tuning functions, such as tuning with tank circuits, but they are more complex and result in a decrease of radiator efficiency.

Figure 3:
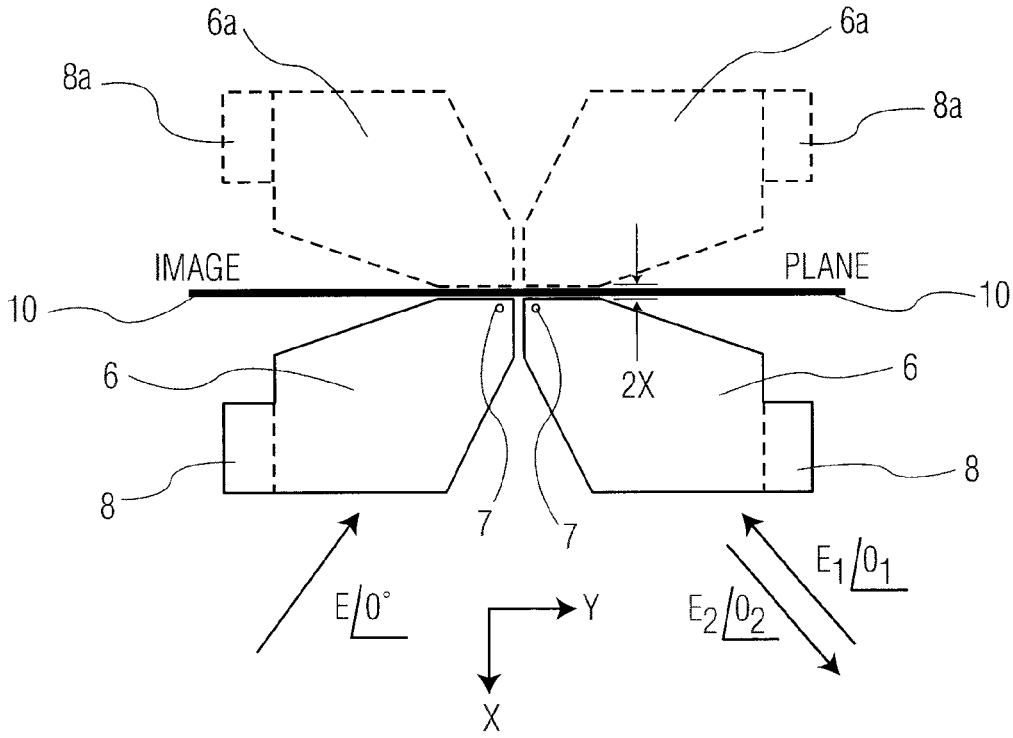
FIG. 3 is a schematic view of the monopole radiating antenna element shown in FIG. 1, depicting two radiating surfaces and two imaging radiating surfaces, according to an embodiment of the present invention.

The RF imaging surfaces will now be described by reference to FIG. 3. As shown, metallic surface 10 forms an RF imaging plane of the present invention. The RF imaging plane, which is formed in the same plane as radiating surfaces 6, are disposed adjacent to RF launchers 7 and perpendicular to RF conductors 14. The close placement of RF launchers 7 to metallic surface 10 effectively forms an electrical simulation of radiating surfaces 6*a* and 8*a*. The simulated radiating surfaces 6*a* and 8*a* are mirror images of radiating surfaces 6 and 8, respectively. As described above, the two simulated radiating surfaces 6*a* are separated from the two radiating surfaces 6 by an electrically determined separation distance 2X. The metallic surface 10 extends between the simulated radiating surfaces 6*a* and radiating surfaces 6.

From an input impedance perspective, the stimulated radiating surfaces 6*a* and 8*a* represent a balanced line excitation of each monopole 6 and expand the useful bandwidth of the present invention. In effect, each monopole 6 exhibits radiation characteristics of a broadband dipole.

Still referring to FIG. 3, the polarization diversity of the present invention will now be described. The invention may be configured to achieve full polarization diversity with the present monopole radiator. Using the left monopole 6 as a reference with an electric field excitation E, as shown in FIG. 3, if the right monopole 6 is excited with $E_1$ at a phase angle $\phi_1$ set to zero degrees and the left monopole 6 is excited with E, the resultant radiated field is linearly polarized in the X direction. Conversely, if the right monopole 6 is excited with $E_2$ at a phase angle $\phi_2$ set to zero degrees and the left monopole 6 is excited with E, the resultant radiated field is linearly polarized in the Y direction.

A full complement of linear polarizations in the X,Y plane may be realized by varying the excitation amplitudes of the relative field strengths. Circular polarization may be realized by setting the field phase angles $\phi_n$ to +90° or −90° for either right hand circular radiation or left hand circular radiation. Any elliptical polarization may result by varying the phase angles $\phi_n$.

The radiating elements 6 may be formed by chemically etching the copper clad dielectric material of substrate 11. The radiating elements 6 are shown in FIGS. 1, 2A, 2B, 3 and 4 (FIG. 4 shows a portion of radiating elements 6).

Figure 4:
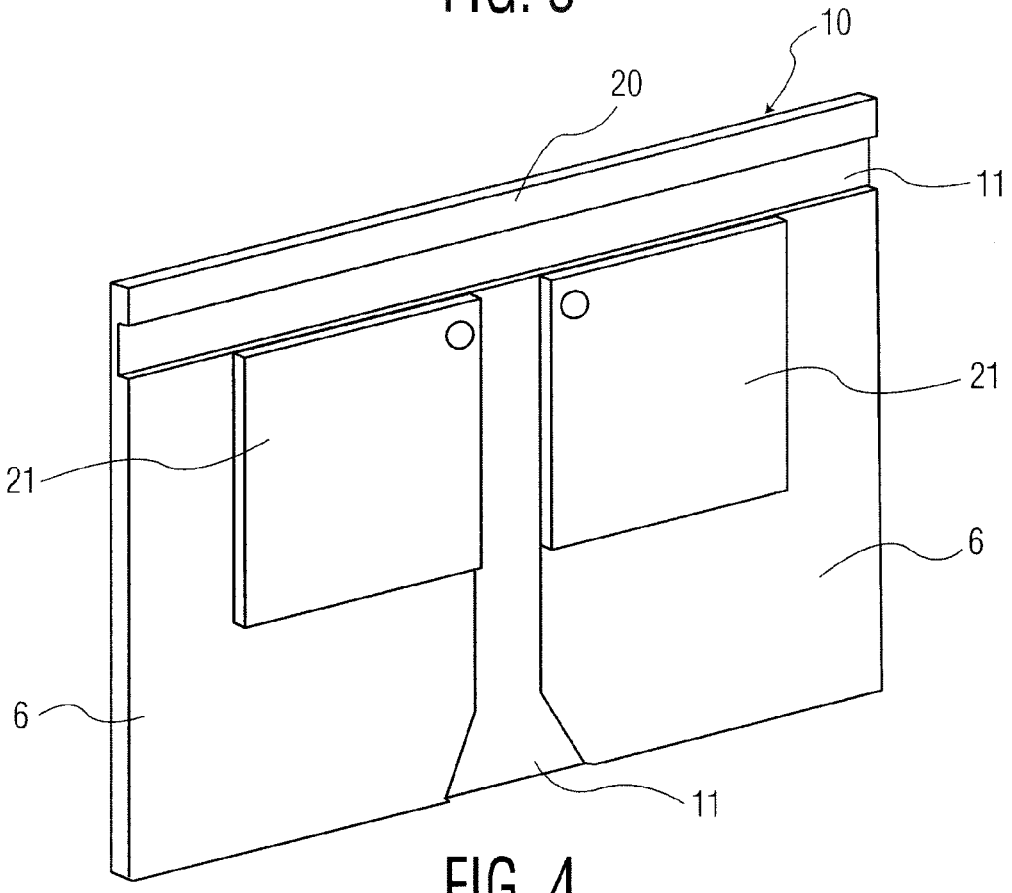
FIG. 4 is a view of the RF feed attachment to the monopole radiating antenna element shown in FIG. 1, according to an embodiment of the present invention (only a portion of the monopole radiating antenna element is shown).
Figure 5:
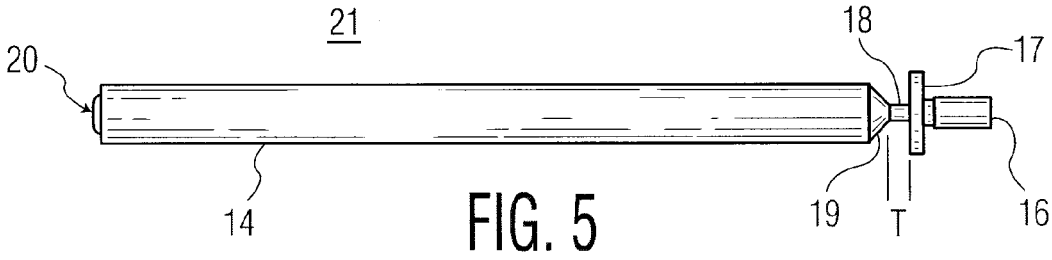
FIG. 5 depicts an RF conductor included in the feed arrangement of the monopole radiating antenna element shown in FIG. 1, according to an embodiment of the present invention.

Connectivity to each of the RF conductors 14 may be achieved using flat socket screws 20 to provide good electrical contacts to respective launchers 7 of radiating elements 6, as shown in FIGS. 4 and 5. Solid metallic plates 21 may be included between the etched radiating elements 6 and screws 20 to assure that radiating elements 6 remain in place during the attachment process.

A transmission line, generally designated as 21, as shown in FIG. 5, includes coaxial bulkhead connector 16 with its dielectric sleeve 18 extending a distance T. The distance T is determined by the thickness of ground plane 13, which is disposed at the bottom of monopole radiating antenna element 4, as shown in FIG. 1. The center conductor of each coaxial connector 16 is positively joined to a respective RF conductor 14 with set screw 19.

The RF conductors 14 for the radiating elements 6 may be arranged as a balanced twin-lead transmission line pair in conjunction with simulated radiating surfaces 6*a* formed by image plane 10. The socket set screw 20 caps an end of RF conductor 14 to provide a positive connection to each radiating surface 6, thereby adding mechanical integrity. Also shown is flange 17 for providing a sturdy connection to ground plane 13 by way of screws (not shown) inserted through flange 17 and ground plane 13.

An exemplary monopole radiating antenna element 4 was fabricated and measured in the 100-800 MHz frequency band. A baseline for the monopole radiating aperture was determined using the general guidelines for biconical antennas as outlined by J. D. Kraus in "Antennas", second edition, published by McGraw-Hill Book Co, 1988, chapter 2. The initial dimensions were then optimized using a three-dimensional Finite Element Analysis (FEA) tool that allows construction of the monopole elements. Exemplary radiation patterns and driving port impedances were computed using numerical computation techniques and accounting for the contributions of the radiating surface extensions and the reactance at the input of the radiating antenna element.

The dimensions of the exemplary antenna were optimized for a maximum operating bandwidth centered at 350 MHz. The tradeoff parameters in FIGS. 2A, 2B and 2C were antenna element volume defined by the length L, the width W and the depth H. From a network point of view, the length L behaves as an inductive component, while the width W and the height of the fold-over extensions D represent capacitance. Additional capacitance may be obtained by varying length A of metallic strip 15 from the element feed points (RF launchers 7). The combined effect provides a tank circuit which may be optimized for maximum operating bandwidth.

A good performance indicator of the radiating antenna element is the VSWR (Voltage Standing Wave Ratio) for both the input to the antenna element from the RF feed and the return loss seen by an incoming plane wave into the antenna element. A desired figure of merit for both conditions may be to operate a broadband antenna element with a VSWR under 2:1. In practice, however, operating an antenna element up to a VSWR of 3:1 ratio may be used, without significantly degrading the overall operating efficiency. It will be appreciated that although this remains a practical bound for high power applications, even wider bandwidths may be possible for low power transmissions or receptions.

Figure 6:
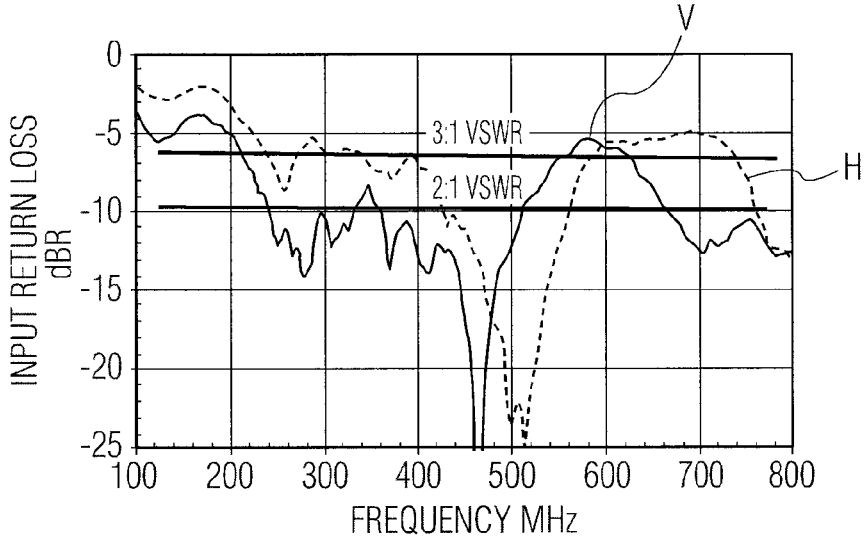
FIG. 6 is a plot of input return loss versus frequency of an exemplary monopole radiating antenna element shown in FIG. 1, according to an embodiment of the present invention.

FIG. 6 shows an optimized VSWR performance for the present invention when measured at the coaxial TNC input connector, whose characteristic impedance is 50 ohms. The designation V represents an E-field orientation in the X axis and the designation H represents an E-Field orientation in the Y axis.

A relationship between VSWR and return loss in FIG. 6 may be expressed as follows:

$$\rho=(\sigma-1)/(\sigma+1)$$

Where: $\rho$ is Return Loss in voltage ratio $\sigma$ is VSWR in voltage ratio.

Exemplary dimensions derived from the optimization may be:

L=22.4 inches

W=11.0 inches

H=7.22 inches

The fold-over extensions D may be 2.4 inches.

The length A of the metallic strips from the feed point may be 3.0 inches.

The dielectric constant of the material of substrate 12 may be 1.35.

It will be understood that when the dielectric constant of the substrate is changed, the depth H of the antenna element may also be adjusted using techniques well known in the art.

The center RF conductors of transmission lines 21 (only one is shown in FIG. 5), behave electrically as described and shown as RF conductors 42 and 43 in FIG. 4 of U.S. Pat. No. 6,853,351, which is incorporated herein by reference. The impedance, and hence the dimensions of the center RF conductors may be determined by appreciating that they form a pair of transmission lines connecting the input of the antenna element to the individual radiating elements. The center RF conductors may also be approximately $\lambda/4$ long, an ideal electrical length for a quarter-wave transformer. The calculated impedance at the feed points of each radiating element is 160 ohms. The RF connectors, when disposed in the presence of the image plane, effectively represent 100 ohms. The resultant impedance then becomes 126 ohms, which corresponds to a conductor diameter of 0.34 inches.

Figure 7:
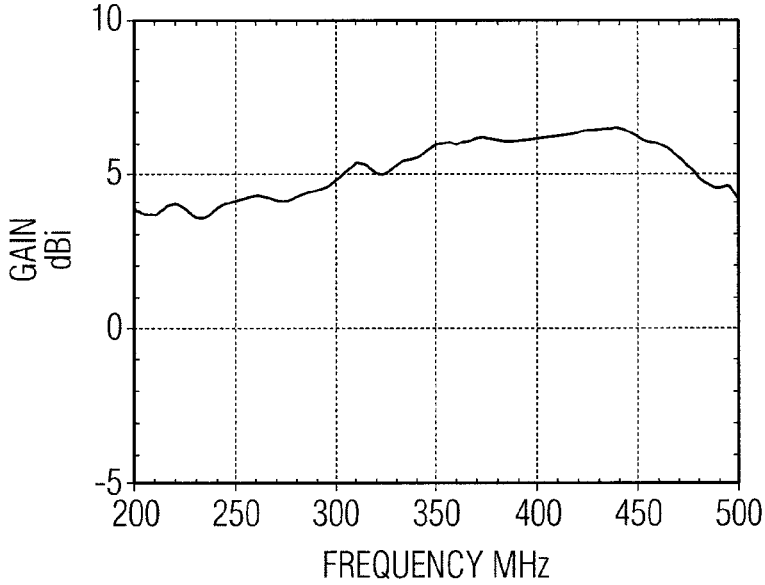
FIG. 7 is a plot of gain versus frequency of an exemplary monopole radiating antenna element shown in FIG. 1, according to an embodiment of the present invention.

The measured gain of the exemplary antenna element to matched polarization is shown in FIG. 7. While these measurements were performed in an anechoic chamber equipped to operate from 200 MHz through 500 MHz, the useful antenna bandwidth is shown in FIG. 6.

Figure 8:
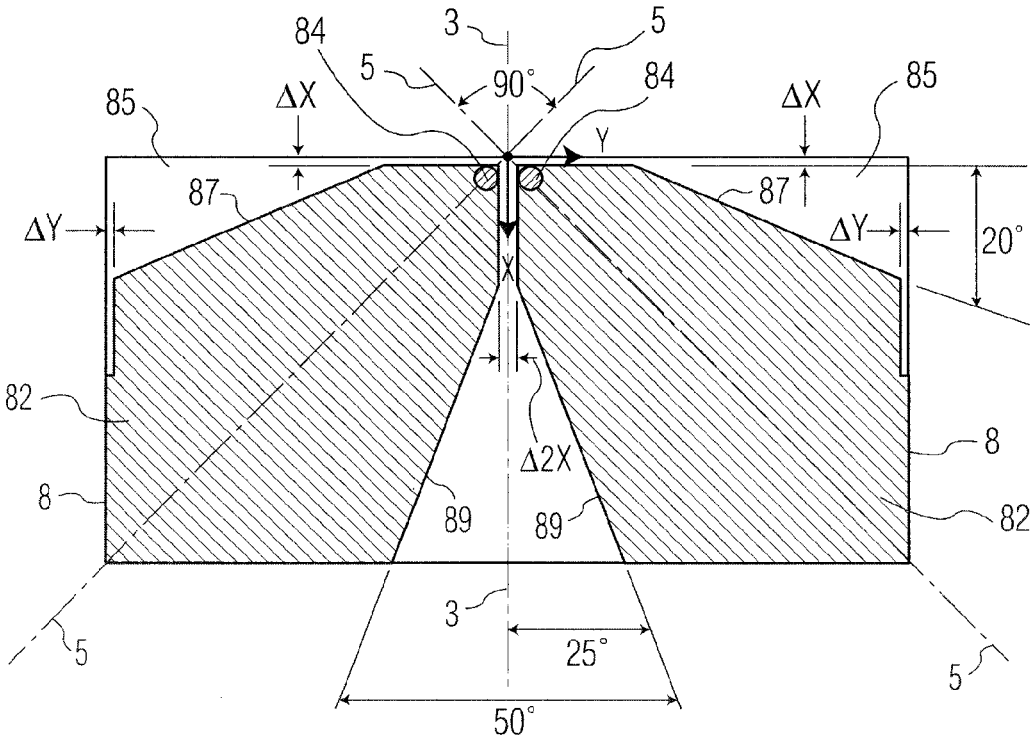
FIG. 8 is a top view of a butterfly arrangement of two radiating surfaces of the monopole radiating antenna element, in accordance with an embodiment of the present invention.

Another embodiment of the present invention is shown in FIG. 8, where a top view of two radiating surfaces 82 are illustrated. Both radiating surfaces are arranged in the X,Y plane on substrate 86, and extend into the X,Z plane, as fold-over extensions 8. Similar to the embodiment shown in FIG. 1, radiating surfaces 82 are arranged as an orthogonal pair in a butterfly pattern. The orthogonal pair is formed conformally on substrate 86 and oriented at 45° with respect to principal antenna axis 3. Two orthogonal lines 5 intersect, as shown, the principal antenna axis.

Proximate to principal antenna axis 3, each radiating surface 82 forms two perpendicular edges extending in the X and Y directions, away from the origin point of the X, Y, Z axes. Adjacent to each intersection of the two perpendicular edges, an RF launcher, designated as 84, extends in the Z direction, perpendicular to substrate 86. The RF launchers 84 also intersect the two orthogonal lines 5.

As shown, each of the two orthogonal lines 5 intersects (a) two perpendicular edges proximate to an RF launcher 84 and (b) two perpendicular edges formed distally on substrate 86 by a respective radiating surface 82. The one edge in the Y direction, proximate to RF launcher 84, has a clearance of $\Delta X$ away from the end of substrate 86. There is a separation of $2\Delta X$ between the other edges in the X direction of the two radiating surfaces 82.

Extending between (a) the two perpendicular edges proximate to RF launcher 84 and (b) the two perpendicular edges disposed distally from RF launcher 84 are respective edges 87 and 89 of each radiating surface 82. The edge 87 makes an angle of 20° (for example, as shown) with respect to the Y axis. The edge 89 makes an angle of 25° (for example, as shown) with respect to the X axis.

A notch, as shown in FIG. 8, is formed between each edge 87 and one of the two perpendicular edges formed distally from each RF launcher 84. The notch has a width of ΔY. The fold-over extensions into the Z axes (best illustrated in FIG. 2B) are shown designated as 8.

Figure 9:
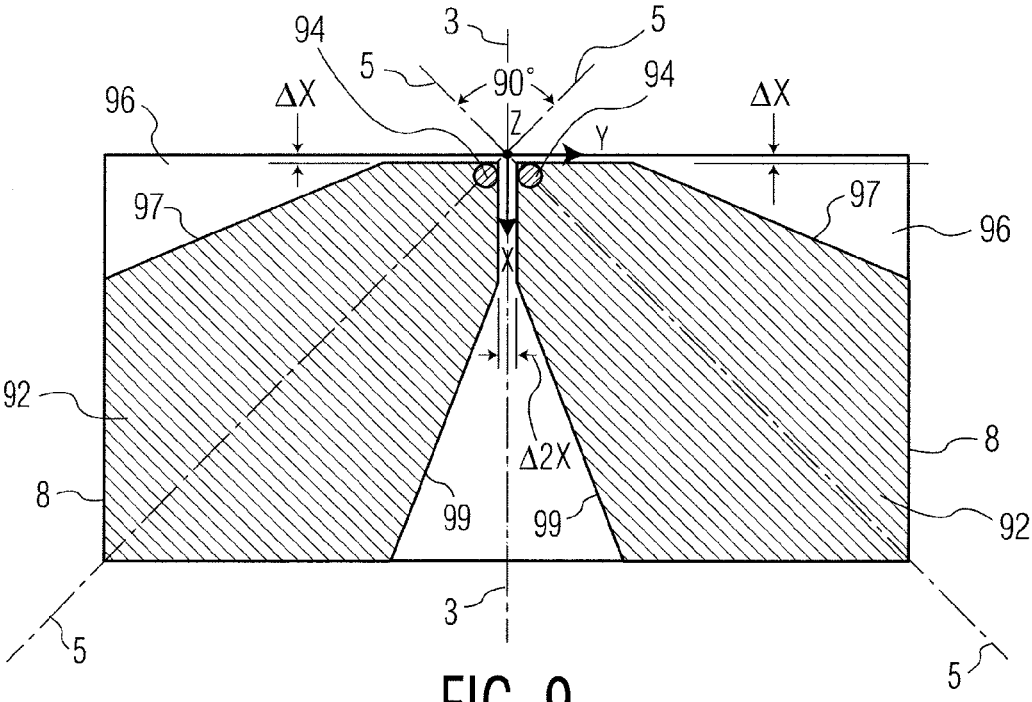
FIG. 9 is top view of another butterfly arrangement of two radiating surfaces of the monopole radiating antenna element, in accordance with another embodiment of the present invention.

Another embodiment of the present invention is shown in FIG. 9, where a top view of two radiating surfaces 92 are illustrated. Both radiating surfaces are arranged in the X,Y plane on substrate 96, and extend into the X,Z plane, as fold-over extensions 8. Similar to the embodiment shown in FIG. 8, radiating surfaces 92 are arranged as an orthogonal pair in a butterfly pattern. The orthogonal pair is formed conformally on substrate 96 and oriented at 45° with respect to principal antenna axis 3. Two orthogonal lines 5 intersect, as shown, principal antenna axis 3.

Proximate to principal antenna axis 3, each radiating surface 92 forms two perpendicular edges extending in the X and Y directions, away from the origin point of the X, Y, Z axes. Adjacent to each intersection of the two perpendicular edges, an RF launcher, designated as 94, extends in the Z direction, perpendicular to substrate 96. The RF launchers 94 also intersect the two orthogonal lines 5.

As shown, each of the two orthogonal lines 5 intersects (a) two perpendicular edges proximate to an RF launcher 94 and (b) two perpendicular edges formed distally on substrate 96 by a respective radiating surface 92. The one edge in the Y direction, proximate to RF launcher 94, has a clearance of ΔX away from the end of substrate 96. There is a separation of 2ΔX between the other edges in the X direction of the two radiating surfaces 92.

Extending between (a) the two perpendicular edges proximate to RF launcher 94 and (b) the two perpendicular edges disposed distally from RF launcher 94 are respective edges 97 and 99 of each radiating surface 92. The edge 97 makes an angle of 20° (for example, as shown) with respect to the Y axis. The edge 99 makes an angle of 25° (for example, as shown) with respect to the X axis.

It will be appreciated that the notch shown in FIG. 8 with a width of ΔY is missing in FIG. 9, as ΔY equals zero in FIG. 9. The fold-over extensions 8 into the Z axis extend along the entire lengths of the perpendicular edges in the X direction formed at the ends of the substrate surface.

Having described an exemplary embodiment of this invention, it is evident that other embodiments incorporating these concepts may be used. For example, frequency scaling of the dimensions may be used to operate in other frequency bands. The types of fasteners, connectors or dielectrics may be varied, with the appropriate electrical compensation. The antenna element may be used in a planar or a conformally shaped phased array structure deployed to any aspect ratio commensurate with the intended spatial coverage. In such applications, the fold-over extension may be excluded and replaced by mutual coupling between adjacent radiating elements, as described in U.S. Pat. No. 7,372,424, which is incorporated herein by reference.

Accordingly, although the invention has been described in one exemplary form with a certain degree of particularity, it is understood that the present disclosure is made only by way of example and that numerous changes in the details of construction and combination of parts may be made without departing from the spirit and the scope of the invention.

What is claimed is:

1. A radiating element comprising a planar substrate having a top surface, two microstrip surfaces mounted in a butterfly pattern on the top surface of the planar substrate, and each microstrip surface folding over an edge of the planar substrate in a downwardly and a substantially perpendicular angle with respect to the top surface of the planar substrate.

2. The radiating element of claim 1 wherein each microstrip surface extends along a 45 degree axis with respect to a principal antenna axis, and each microstrip surface forms (a) two perpendicular first edges, proximate to the principal antenna axis, extending symmetrically about the 45 degree axis, (b) two perpendicular second edges, distally from the principal antenna axis, and (c) two non-parallel third edges, extending between the first edges and the second edges, respectively.

3. The radiating element of claim 2 wherein each microstrip surface forms a rectangular portion that is folded over the edge of the planar substrate and extends from a respective second edge in a substantially perpendicular angle.

4. The radiating element of claim 1 wherein the microstrip surfaces mounted on the top surface of the planar substrate are configured to operate in a first frequency band, the microstrip surfaces folding over the edge of the planar substrate are configured to operate in a second frequency band, and the second frequency band is lower than the first frequency band.

5. The radiating element of claim 1 wherein each microstrip surface is configured to provide a polarized electric field component that is orthogonal to another polarized electric field component of the other microstrip surface.

6. The radiating element of claim 1 including an RF launch point disposed adjacent to an end of each respective microstrip surface, and a metallic plane oriented adjacent to the RF launch point and perpendicular to the microstrip surfaces, wherein an RF image surface, substantially similar to each microstrip surface is formed in the same plane and perpendicular to the metallic plane.

7. The radiating element of claim 6 wherein the metallic plane intersects mid-way between the end of each respective microstrip surface and an end of each respective RF image surface.

8. The radiating element of claim 1 including a ground plane disposed opposite the planar substrate, and a dielectric material sandwiched between the ground plane and the planar substrate.

9. The radiating element of claim 1 including an RF launch point disposed adjacent to an end of each respective microstrip surface, and an RF conductor having one end connected to the RF launch point and another end configured to receive or transmit radiation from each respective microstrip surface.

10. The radiating element of claim 9 including a metallic strip connected to the RF conductor and extending in a direction away from the RF conductor, wherein the metallic strip is configured to provide a capacitive impedance.

11. A radiating element comprising a substrate, and two radiating surfaces conformally mounted on the substrate, wherein each of the radiating surfaces is of a triangular shape arranged to form a butterfly configuration, and the radiating surfaces on the front face of the substrate are extended and orthogonally folded over respective edges of the substrate.

12. The radiating element of claim 11 wherein the two radiating surfaces are orthogonal to each other.

13. The radiating element of claim 11 wherein the two radiating surfaces are disposed on a front face of the substrate, and an RF center conductor is orthogonally oriented toward a back face of the substrate, and connected to each of the two radiating surfaces for feeding an RF signal to or from the two radiating surfaces.

14. The radiating element of claim 11 wherein the two radiating surfaces are disposed on the front face of the substrate, a ground layer is disposed facing a rear face of the substrate, and a dielectric layer is sandwiched between the ground layer and the substrate.

15. The radiating element of claim 11 including

RF center conductors oriented substantially perpendicular to the radiating surfaces, respectively, for feeding an RF signal to or from the radiating surfaces, and a metallic strip orthogonally oriented with respect to a respective RF center conductor and attached to the respective RF center conductor for providing a capacitive impedance.

16. The radiating element of claim 11 including a metallic surface disposed orthogonally to the radiating surfaces for providing an RF imaging plane for the radiating surfaces.

17. The radiating element of claim 11 including multiple sets of two radiating surfaces conformally mounted on the substrate to form an array of radiators.

18. A phased array comprising multiple sets of two radiating surfaces conformally mounted on a planar substrate, wherein each set of two radiating surfaces includes two microstrip surfaces mounted in a butterfly pattern on a top surface of the planar substrate, and each microstrip surface folding over an edge of the planar substrate in a downwardly and a substantially perpendicular angle with respect to the top surface of the planar substrate.

19. The radiating element of claim 18 wherein each microstrip surface extends along a 45 degree axis with respect to a principal antenna axis, and each microstrip surface forms (a) two perpendicular first edges, proximate to the principal antenna axis, extending symmetrically about the 45 degree axis, (b) two perpendicular second edges, distally from the principal antenna axis, and (c) two non-parallel third edges, extending between the first edges and the second edges, respectively.

* * * * *